United States Patent [19]

Spitzke

[11] 4,322,901

[45] Apr. 6, 1982

[54] NEEDLEWORK FRAME

[75] Inventor: Arthur Spitzke, Oxford, Mich.

[73] Assignee: Schmelzer Corporation, Flint, Mich.

[21] Appl. No.: 153,434

[22] Filed: May 27, 1980

[51] Int. Cl.[3] ..... D06C 3/08

[52] U.S. Cl. ..... 38/102.6; 38/102.9; 38/102.91

[58] Field of Search ..... 38/102.6, 102.9, 102.91

[56] References Cited

U.S. PATENT DOCUMENTS 2,451,207 10/1948 Ferguson ..... 38/102.6 X 3,811,209 5/1974 Hanley ..... 38/102.6

3,878,629 4/1975 Grube ..... 38/102.91

4,194,312 3/1980 Connors et al. ..... 38/102.91 X

*Primary Examiner*—Louis Rimrodt

*Attorney, Agent, or Firm*—Fisher, Gerhardt, Crampton & Groh

[57] ABSTRACT

An adjustable frame assembly for releasably clamping fabric material for needlework in which four identical frame members are detachable and adjustable relative to each other to form a frame of a selected size and which employs clamping elements cooperating with the frame to hold fabric material in a taut relationship to the frame without puncturing the fabric.

7 Claims, 5 Drawing Figures

NEEDLEWORK FRAME

This invention relates to frames for holding fabric material during the performance of needlework and more particularly to such frames which are adjustable.

In certain forms of needlework, particularly the form called needlepoint, it is desirable to maintain the fabric in a stretched, taut condition on the frame so that both sides of the fabric material are exposed for work. During the course of such work, the threads applied to the fabric material tend to warp or distort the material. It is for this reason that it is desirable to maintain the material in a rigid frame to minimize such distortion. Also, it is very desirable that the fabric be easily attached and detached from the frame without harming the material.

It is an object of the invention to provide an adjustable frame assembly for use in holding fabric during the performance of needlework.

Another object of the invention is to provide an adjustable frame which is easily assembled for use and disassembled for storage purposes.

Still another object of the invention is to provide an adjustable frame in which a minimum number of different shaped parts are required to provide a frame which is durable, economical and easy to manufacture.

These and other objects of the invention are accomplished by an adjustable frame assembly for releasably clamping four sides of a piece of fabric material which includes four identically shaped frame members each of which has a head and elongated body member extending from the head. The heads have openings slidably receiving the body member of another frame member in transversely extending relation so that the heads are located at the corners of the four sided frame and the body members form the sides of the frame. Opposite frame members are disposed in parallel relationship to each other and are movable to a predetermined spacing relative to each other at which point they may be detachably fixed in the selected position by a pin removably inserted in aligned openings in the head member of one of frame member and the body member of an adjacent frame member. Each of the body members form longitudinally extending grooves to receive a plurality of clamping elements at selected points. The clamping elements are provided with portions which interfere with the side walls of the body members so that the clamping elements can be snapped into position in the groove. The various elements of the frame assembly are formed of plastic materials so that fabric material may be disposed in the groove and held in position by the clamping elements which are snapped over the material. The head portions of the frame members are formed so that they expose the inner borders of the frame members making it possible for fabric clamped in the corners of the frame assembly to lie in the same plane as the remaining portion of the fabric material to avoid wrinkles and the like in the corner areas.

These and other objects of the invention are accomplished by the embodiment of the invention disclosed in the following description and illustrated in the drawings in which.

Figure 1:
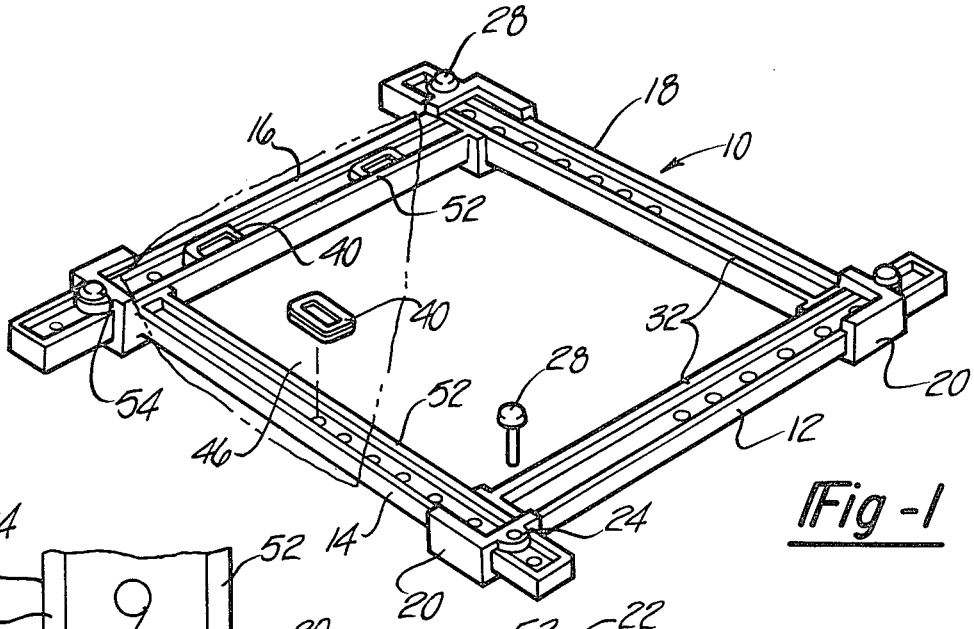
FIG. 1 is a perspective view of a frame assembly embodying the present invention.
Figure 2:
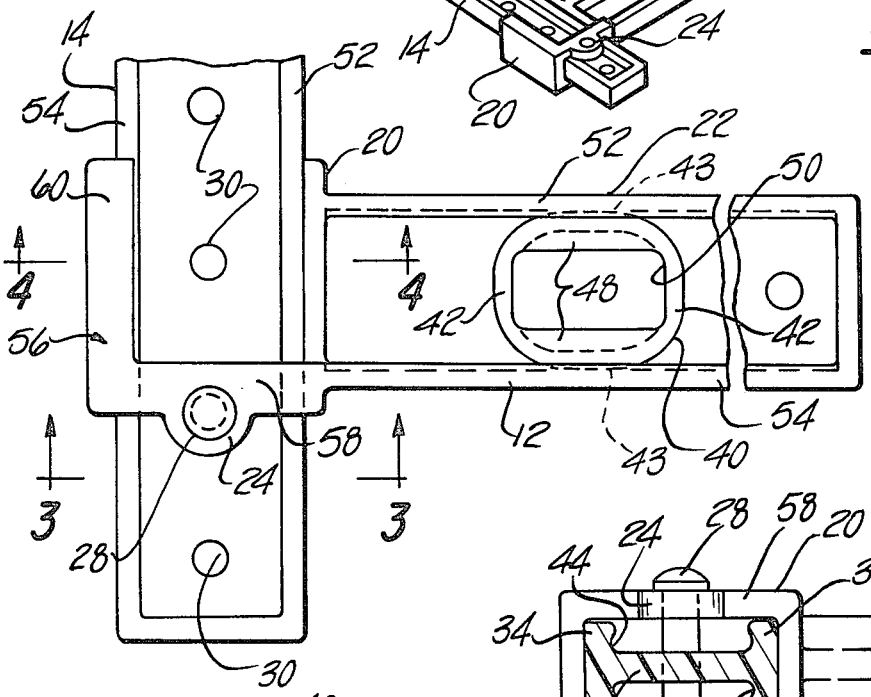
FIG. 2 is a plan view of a corner portion of the frame assembly seen in FIG. 1 but at a greatly enlarged scale.
Figure 3:
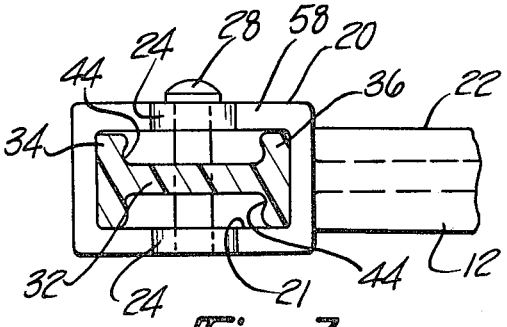
FIG. 3 is a cross sectional view taken on line 3—3 in FIG. 2.
Figure 4:
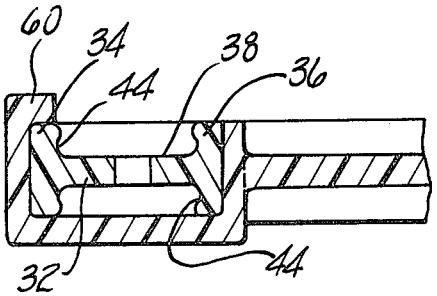
FIG. 4 is a cross sectional view taken on line 4—4 in FIG. 2.

Referring to the drawings and particularly to FIG. 1, the frame assembly embodying the invention is designated generally at 10 and includes four identical frame members 12, 14, 16 and 18 made of plastic material. The frame members 12 through 18 each include a head portion 20 at one end of an elongated body member 22. The body members 22 have a generally H-shaped cross section as best seen in FIGS. 3 and 4 and are adapted to be slidably received by the box-like head portions 20 so that in their joined position, as illustrated in FIG. 2, the body members 22 of adjacent frame members 12 and 14, for example, extend transversely to each other.

Each of the head portions 20 is provided with a pair of spaced upper and lower ears 24 with aligned openings 26 to receive a fastening pin 28. The fastening pins 28 pass through a selected one of uniformly spaced openings 30 in the web 32 of the body member 22 to maintain the head member 20 of the frame members 12, 14, 16 and 18 in selected relationship relative to the adjacent body members of frame members 14, 16, 18 and 12, respectively.

Figure 5:
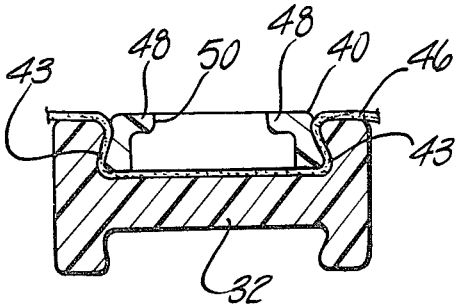
FIG. 5 is a cross sectional view taken generally on line 5—5 in FIG. 2 but with fabric material fastened in position.

Each of the body members 22 has opposed flanges or walls 34 and 36 which are spaced apart to form an upper recess or channel shaped groove 38 and a lower groove 39. The upper groove 38 is adapted to receive a number of clamping elements 40. The clamping elements 40 have a general O-shape with opposed sidewalls 41 and end walls 42. The sidewalls 41 have protruding portions 43 extending outwardly in opposite directions as best seen in FIG. 5. When the clamping elements are disposed in the groove 38, the protruding portions 43 interfere with undercut groove areas 44. All of the components are made of a relatively resilient plastic material so that the clamping elements can be snapped into the grooves 38. In FIG. 2, the clamping element 40 is illustrated clamped in the groove 38 without fabric. The parts are sufficiently flexible so that a piece of fabric 46 can be interposed between the body member 22 and the clamping elements as seen in FIG. 5. In that condition, the fabric 46 is held in detachable fixed relationship to the body member. Removal of the clamping elements 40 is facilitated by opposed flanges 48 formed at the upper edge of the sidewalls 41. A tool or instrument such as a screwdriver can be inserted through the opening 50 formed between the side walls 41 and end walls 42 to engage one of the flanges 48. A prying action with the tool serves to release the clamping element 40 from the groove 38.

In the assembled condition of the frame assembly 10 as seen in FIG. 1, opposite frame members 12 and 16 or 14 and 18 are disposed in parallel relationship to each other for all adjusted positions so that a variety of frame sizes can be formed. The maximum frame size is determined by the length of the frame members 12 through 18 which can be of any desirable convenient length. The minimum size of the frame is determined by the location of the opening 30 closest to the associated head 20. It will be understood that openings 30 can be spaced for the full length of the body members in which case the opening within the frame member can be made very small.

The inner walls 34 of the assembled frame 10 have top surfaces 52 defining an inner border or perimeter of the frame assembly 10. Similarly, the outer walls 36 of the body members 22 have top surfaces 54 forming the outer perimeter or border of the frame assembly 10. The head portions 20 are so formed that the inner surfaces or border 52 are exposed at each of the corners of the frame assembly to receive the fabric 46. For this purpose, the upper portion of each of the heads 20 have a right angle flange portion with a leg 58 in longitudinal alignment with the border 54 of the attached body member 22 and a leg portion 60 in alignment with the border 54 of the adjacent body member 22. In this manner, the leg portions 58 and 60 overlie the outer borders 54 at the corners of the frame assembly whereas the inner borders 52 are exposed. This makes it possible for clamping elements to be positioned outwardly of the inner borders 52 so that fabric 46 overlying the border 52 lies flat at the corners. Also, the location of the pin receiving ear 24 is outward of the outer border 54 to permit the inner border corners to be exposed.

During needlework, fabric overlies the upper surfaces of the frame members 12 through 18 including the groove 38. However, the groove 39 at the underside of the body members 22 remain exposed. This forms a convenient location for storing clamping elements which may not be in use.

The parts making up the frame assembly 10 typically are stored with the frame members 12 through 18 disassembled from each other and with the clamping elements 40 snapped into the grooves 38 or 39 and with pins 28 placed in the openings 26. This makes a small compact package requiring little storage room and can be conveniently carried with other materials used for needlework.

The parts of the frame assembly 10 are placed in condition for use by removing the fastening pins 28 from the heads 20 and by inserting the ends of the body members 22 of one frame member into the opening 21 formed by the heat 20 of another frame member. With all of the frame members 12, 14, 16 and 18 slidably connected to each other, opposite frame members such as 12 and 16 may be moved relative to each other to obtain the desired spacing for one dimension of the fabric 46 upon which needlework is to be performed. Thereafter, the fastening pins 28 associated with the heads 20 of the frame members 12 and 16 are pressed into position to openings 26 in the heads and a selected opening 30 in adjacent frame members 14 and 18, respectively. Thereafter, the remaining frame members 14 and 18 may be moved to a selected position to determine the other dimension of the fabric 46 at which point the fastening pins 28 associated with the frame members 14 and 18 are placed in position through openings 30 in the adjacent frame members 12 and 16 respectively. The fastening pins 28 also are made of plastic material and can be formed with a sufficiently loose fit to be inserted through the aligned openings 26 and 30, since once the fabric 46 is in position, the tension thereof will tend to frictionally maintain the fastening pins 28 in their inserted position.

After the selected frame size has been established, the piece of fabric material 46 is laid over the frame. No particular procedure is required for inserting of the clamping element 40, but by way of example, after a clamping element 40 has been inserted in the frame member 12 at a point midway between associated head portions 20, the fabric material 46 can be slightly stretched, and a clamping element inserted in the opposite body member 22 of the frame member 16. Insertion of opposite clamping elements in this manner tends to stretch the fabric material 46 and lock it in a taut condition.

With the frame assembled and the fabric 46 stretched and clamped in position, the material is ready for needlework with opposite sides of the material exposed and available to be worked. Upon completion of the work, or at any time during its progress, the clamping elements 40 may be easily removed and the fabric material 46 can be completely removed or repositioned.

An adjustable frame assembly for releasably clamping fabric material for needlework has been provided in which four substantially identical frame members are detachably fastened together to form a frame having selected dimensions so that a piece of fabric material upon which needlework is to be performed, can be detachably clamped to the frame in a fixed, taut relationship which exposes both sides of the fabric material for access during needlework.

The embodiments of the invention in which an exclusive property or privilege is claimed we defined as follows:

1. An adjustable frame assembly for releasably clamping four sides of a piece of fabric material, comprising; four frame members, each frame member including a head and an elongated body member extending from the head, the head of each frame member having an opening slidably receiving the body member of another frame member in transversely extending relationship thereto to form frame corner portions, fastening means detachably cooperating with each head opposite the associated body member and a slidably received frame member to hold adjacent frame members in selected position relative to each other to define four sides of the frame assembly, each body member having spaced apart walls forming a channel shaped groove therebetween and the top surfaces of said walls defining inner and outer borders, respectively of said frame assembly, a plurality of clamping elements each having opposed portions interfering with said spaced apart walls whereby fabric material disposed in said grooves is clamped in said grooves by said clamped elements, said head having portions aligned and engagable with the outer borders of adjacent body members and engaging top surfaces thereof and leaving the remainder of the head open to expose said grooves in said body member outwardly of the inner border of each of said frame members to receive said clamping elements.

2. The adjustable frame assembly of claim 1 wherein said fastening means each includes a pin passing through an aligned aperature in one of said heads and a selected one of a plurality of uniformly spaced aperatures in each of said body members.

3. The frame assembly of claim 1 wherein said clamping elements each have opposite portions engaged with opposite side of said groove to maintain said clamping elements in said groove and each clamping element has a tool receiving portion to receive a tool for removing said clamping elements from said groove.

4. The frame assembly of claim 1 wherein said clamping elements each have pairs of opposed parallel side portions engagable with opposite sides of said groove and opposed end walls joined together to form an opening forming a tool receiving portion for removing said clamping elements from said grooves.

5. The frame assembly of claim 1 wherein each body member includes upper surface having an inner border and an outer border at opposite sides of said groove, said inner border defining the perimeter of an opening giving access to opposite sides of a piece of fabric material clamped to said frame assembly.

6. The frame assembly of claim 1 wherein each of said heads has an upper portion forming a right angle flange with one leg in alignment with the outer border of the same frame member and the other leg member in alignment with the outer border of the body member of the adjacent frame member, said legs engaging the top of the adjacent body member and forming a recess exposing portions of the top of the adjacent body member at a corner of said frame to receive a clamping element and fabric therein.

7. The frame assembly of claim 1 wherein said body members have an H-shaped cross section forming oppositely facing upper and lower grooves, said upper grooves receiving said clamping elements to hold said fabric material and said lower grooves receiving the remainder of said clamping elements to store the latter.

* * * * *